US012414661B1

(12) United States Patent
Hutchinson

(10) Patent No.: US 12,414,661 B1
(45) Date of Patent: Sep. 16, 2025

(54) SALON OR BARBERSHOP ANTI-FATIGUE MAT AND BROOM

(71) Applicant: Tyrone Hutchinson, Florence, SC (US)

(72) Inventor: Tyrone Hutchinson, Florence, SC (US)

( * ) Notice: Subject to any disclaimer, the term of this patent is extended or adjusted under 35 U.S.C. 154(b) by 386 days.

(21) Appl. No.: 18/103,550

(22) Filed: Jan. 31, 2023

(51) Int. Cl.

| | |
|---|---|
| ***A47L 7/00*** | (2006.01) |
| ***A47G 27/02*** | (2006.01) |
| ***A47L 9/06*** | (2006.01) |
| ***A47L 9/24*** | (2006.01) |
| ***A47L 9/32*** | (2006.01) |

(52) U.S. Cl.
CPC ..... *A47L 7/0085* (2013.01); *A47G 27/0231* (2013.01); *A47L 9/0606* (2013.01); *A47L 9/248* (2013.01); *A47L 9/32* (2013.01)

(58) Field of Classification Search
CPC .... A47G 27/0231; A47L 7/0085; A47L 9/248
See application file for complete search history.

(56) References Cited

U.S. PATENT DOCUMENTS

| | | | | |
|---|---|---|---|---|
| 2,538,464 | A * | 1/1951 | Macfarland | A47L 5/32 474/119 |
| 4,114,230 | A * | 9/1978 | MacFarland | A47L 7/04 15/330 |
| 5,022,385 | A * | 6/1991 | Harza | B60N 2/976 601/149 |
| D713,654 | S * | 9/2014 | Robbins, III | D6/582 |
| 9,861,220 | B2 * | 1/2018 | Burkhalter | B32B 3/08 |
| 10,582,793 | B1 * | 3/2020 | McMahan | B32B 5/32 |
| 2002/0106480 | A1 | 8/2002 | Vallieres | |
| 2003/0203164 | A1 * | 10/2003 | Healy | B32B 5/30 428/354 |
| 2013/0084413 | A1 * | 4/2013 | McMahan | B32B 3/26 428/68 |
| 2016/0176329 | A1 * | 6/2016 | Aronow | B60N 3/048 29/428 |
| 2017/0172331 | A1 * | 6/2017 | Publicover | B32B 7/022 |
| 2017/0273490 | A1 * | 9/2017 | McMahan | B32B 5/245 |
| 2019/0008302 | A1 * | 1/2019 | Publicover | A47G 27/0231 |
| 2022/0071425 | A1 * | 3/2022 | Heath | B32B 7/08 |

FOREIGN PATENT DOCUMENTS

| | | |
|---|---|---|
| WO | 2016141273 | 9/2016 |

* cited by examiner

*Primary Examiner* — Marc Carlson
(74) *Attorney, Agent, or Firm* — Kyle A. Fletcher, Esq.

(57) ABSTRACT

The salon and barbershop anti-fatigue mat and broom is a therapeutic device. The salon and barbershop anti-fatigue mat and broom is a cleaning device. The salon and barbershop anti-fatigue mat and broom forms a pedestal on which an individual stands. The salon and barbershop anti-fatigue mat and broom comprises a cushion structure and a cleaning tool. The cushion structure protects the legs of the individual standing on the cushion structure. The cleaning tool cleans the cushion structure and the supporting surface surrounding the cushion structure. The cushion structure is an inflatable structure. The cleaning tool further inflates the cushion structure.

8 Claims, 4 Drawing Sheets

SALON OR BARBERSHOP ANTI-FATIGUE MAT AND BROOM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of foot mats for fighting fatigue.

SUMMARY OF INVENTION

The salon and barbershop anti-fatigue mat and broom is a therapeutic device. The salon and barbershop anti-fatigue mat and broom is a cleaning device. The salon and barbershop anti-fatigue mat and broom forms a pedestal on which an individual stands. The salon and barbershop anti-fatigue mat and broom comprises a cushion structure and a cleaning tool. The cushion structure protects the legs of the individual standing on the cushion structure. The cleaning tool cleans the cushion structure and the supporting surface surrounding the cushion structure. The cushion structure is an inflatable structure. The cleaning tool further inflates the cushion structure.

These together with additional objects, features and advantages of the salon and barbershop anti-fatigue mat and broom will be readily apparent to those of ordinary skill in the art upon reading the following detailed description of the presently preferred, but nonetheless illustrative, embodiments when taken in conjunction with the accompanying drawings.

In this respect, before explaining the current embodiments of the salon and barbershop anti-fatigue mat and broom in detail, it is to be understood that the salon and barbershop anti-fatigue mat and broom is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the salon and barbershop anti-fatigue mat and broom.

It is therefore important that the claims be regarded as including such equivalent construction insofar as they do not depart from the spirit and scope of the salon and barbershop anti-fatigue mat and broom. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
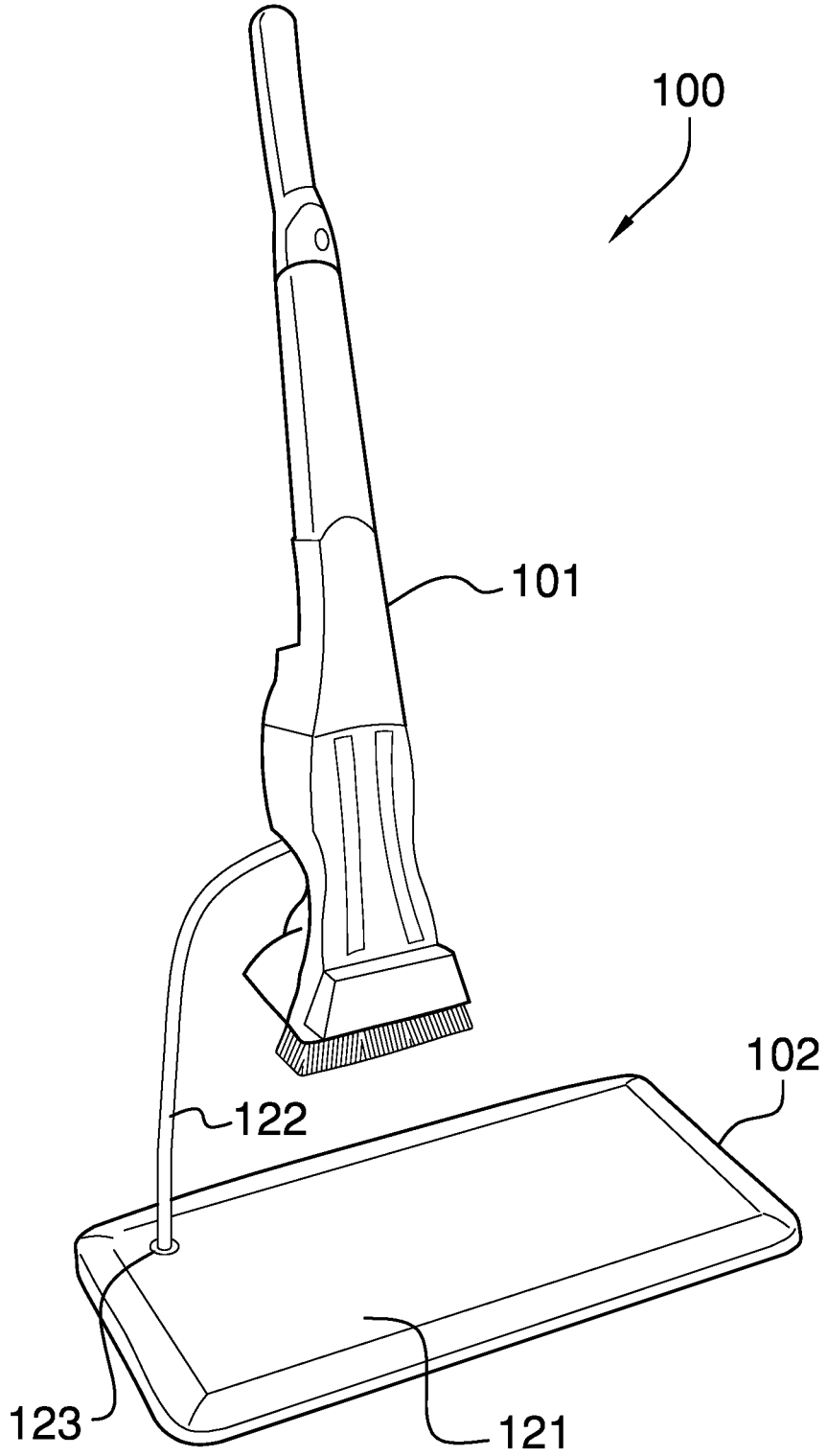
FIG. 1 is a perspective view of an embodiment of the disclosure.
Figure 2:
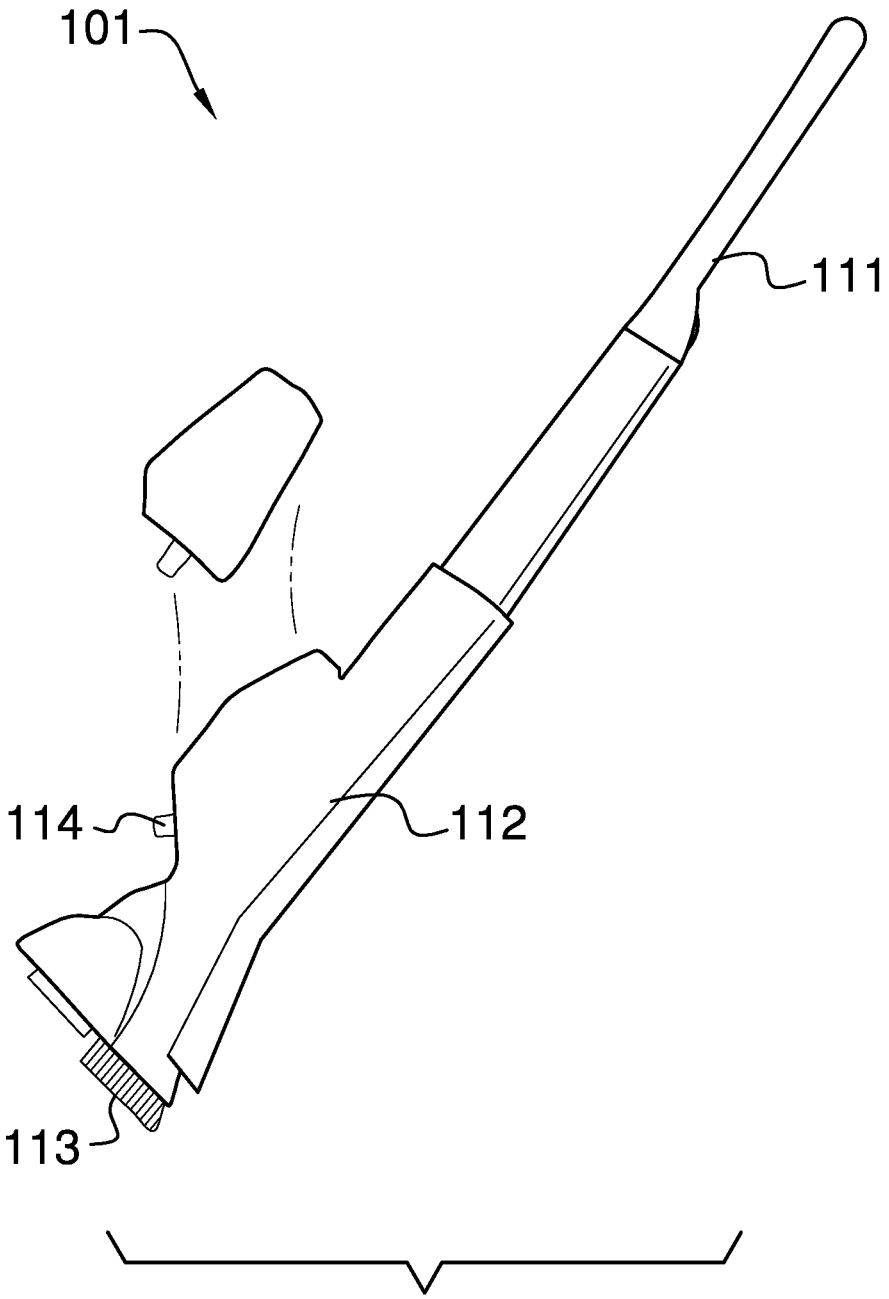
FIG. 2 is a detail view of an embodiment of the disclosure.
Figure 3:
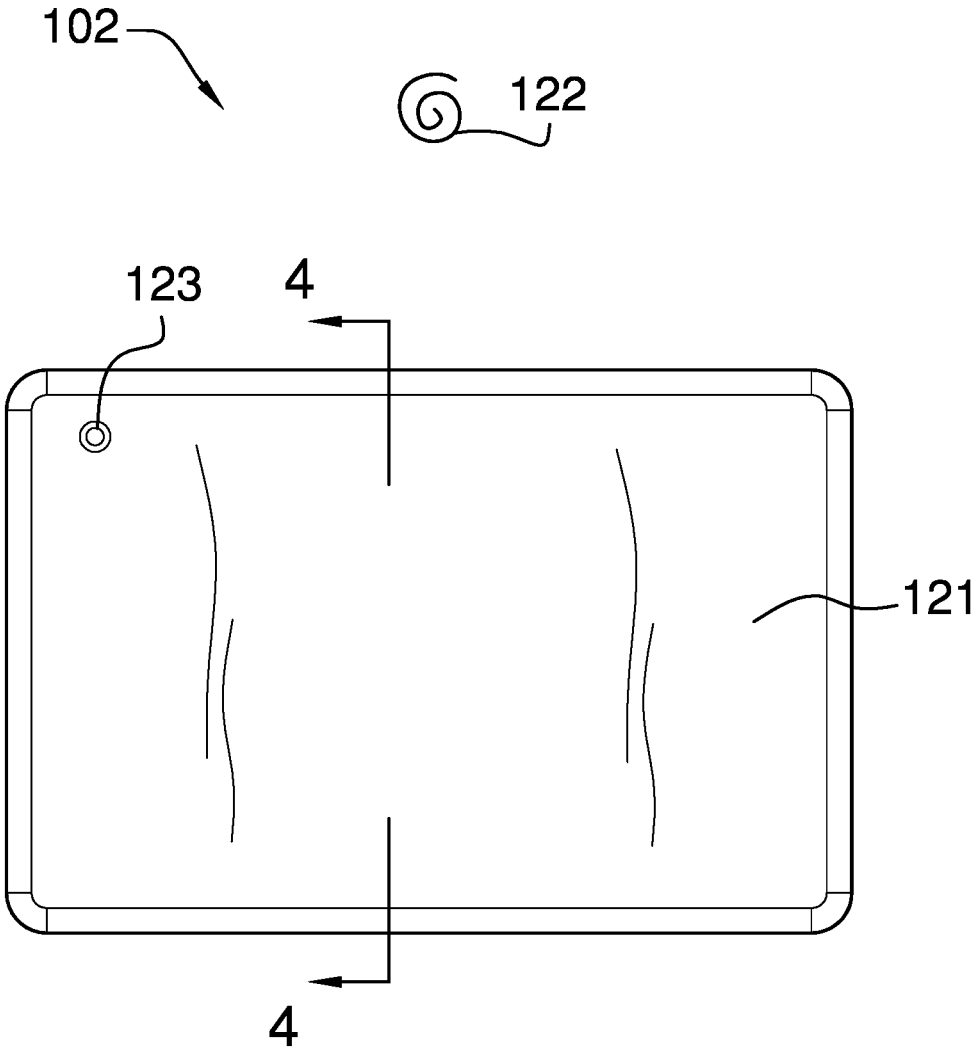
FIG. 3 is a detail view of an embodiment of the disclosure.
Figure 4:
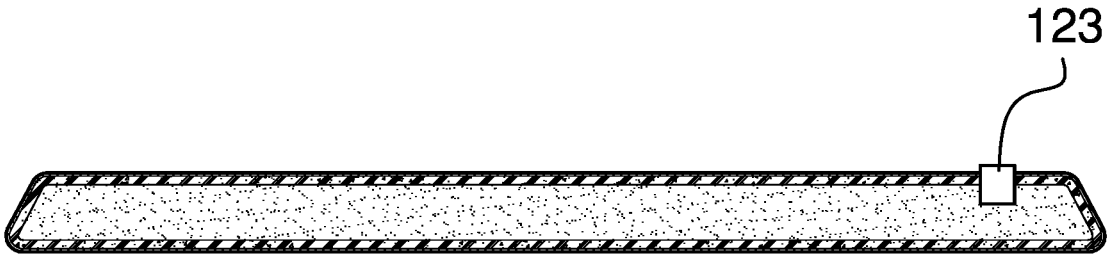
FIG. 4 is a cross-sectional view of an embodiment of the disclosure across 4-4 as shown on FIG. 3.

Detailed reference will now be made to one or more potential embodiments of the disclosure, which are illustrated in FIGS. 1 through 4.

The salon and barbershop anti-fatigue mat and broom 100 (hereinafter invention) is a therapeutic device. The invention 100 is a cleaning device. The invention 100 forms a pedestal on which an individual stands. The invention 100 comprises a cushion structure 102 and a cleaning tool 101. The cushion structure 102 protects the legs of the individual standing on the cushion structure 102. The cleaning tool 101 cleans the cushion structure 102 and the supporting surface surrounding the cushion structure 102. The cushion structure 102 is an inflatable structure. The cleaning tool 101 further inflates the cushion structure 102.

The cushion structure 102 is a pedestal. The cushion structure 102 is an inflatable structure. The cushion structure 102 forms an elastic structure when inflated. The cleaning tool 101 generates the pressure differential used to inflate the cushion structure 102. The inflated cushion structure 102 forms a pad on which an individual stands. The cushion structure 102 comprises a bladder structure 121 and a hose structure 122.

The bladder structure 121 is a bladder. The bladder is a fluid impermeable structure. The bladder structure 121 is an inflatable structure. The bladder structure 121 receives air under pressure from the working element 112 of the cleaning tool 101. The bladder structure 121 contains the received air such that the bladder structure 121 forms an elastic structure. The bladder structure 121 forms the pad on which an individual can stand.

The hose structure 122 is a flexible tubular structure. The hose structure 122 is a fluid transport structure. The hose structure 122 forms a fluidic connection between the discharge port 114 of the working element 112 and the intake port 123. The hose structure 122 forms a detachable fluidic connection with the discharge port 114. The hose structure 122 forms a detachable fluidic connection with the intake port 123. The hose structure 122 transports pressurized air to the intake port 123. The bladder structure 121 further comprises an intake port 123.

The intake port 123 is a fitting. The intake port 123 is a fluid port. The intake port 123 forms a fluidic connection between the hose structure 122 and the bladder structure 121. The intake port 123 receives the air the pressurized air used to inflate the bladder structure 121 from the hose structure 122.

The cleaning tool 101 is a tool. The cleaning tool 101 removes detritus from the superior surface of the cushion structure 102. The cleaning tool 101 removes detritus from the supporting surface surrounding the cushion structure 102. The cleaning tool 101 creates a pressure differential that generates a vacuum. The cleaning tool 101 uses the vacuum to create a suction that draws the detritus into the cleaning tool 101 for storage and subsequent disposal. The cleaning tool 101 forms a detachable fluidic connection with the cushion structure 102. The pressure differential generated by the cleaning tool 101 is further used by the cushion structure 102 to inflate the cushion structure 102. The cleaning tool 101 comprises a handle structure 111 and a working element 112.

The handle structure 111 forms a grip used to carry and manipulate the invention 100. The handle structure 111 is a rigid structure. The handle structure 111 has a prism shape. The handle structure 111 attaches to the working element 112.

The working element 112 is the working structure of the tool formed by the cleaning tool 101. The working element 112 generates a friction used to clean the cushion structure 102. The working element 112 generates the vacuum used to remove detritus from the cushion structure 102. The working element 112 generates a pressure differential used to inflate the cushion structure 102. The working element 112 further comprises a broom structure 113 and a discharge port 114.

The broom structure 113 is a broom. The broom structure 113 is used to collect detritus that has fallen on the cushion structure 102 and the supporting surface surrounding the cushion structure 102. The broom structure 113 brings the detritus to a single location that allows the vacuum generated by the working element 112 to draw the detritus into the working element 112 for storage.

The discharge port 114 is a fitting. The discharge port 114 is a fluid port. The discharge port 114 forms a fluidic connection between the cushion structure 102 and the working element 112. The discharge port 114 receives the air that is pressurized by the pressure differential generated by the working element 112. The working element 112 pumps the pressurized air into the cushion structure 102 to inflate the cushion structure 102.

The following definitions were used in this disclosure:

Bladder: As used in this disclosure, a bladder is fluid impermeable structure. The internal volume of the structure can be varied by: a) varying the pressure and/or quantity of a fluid contained within the bladder; or b) varying the quantity of a liquid contained within the bladder. Bladders are commonly used for storage of a fluid and as a cushion.

Bristle: As used in this disclosure, a bristle is a short coarse stiff hair or hair like object.

Broom: As used in this disclosure, a broom is a brush used to clean a horizontal surface by sweeping detritus off of the horizontal surface.

Clean: As used in this disclosure, the term clean refers to an object without dirt, unwanted markings, or undesirable pathogens. When referring to a surface, the term clean can also refer to removing unwanted objects from the surface. The term cleaning refers to the action of making an object clean.

Compress: In this disclosure, compress means to apply a force to force a fixed mass of material into a smaller volume of space.

Compressed Air: In this disclosure, compressed air means atmospheric gases that has been compressed to a pressure greater than normal temperature and pressure.

Cushion: As used in this disclosure a cushion is a structure formed with a pad that is used to prevent injury or damage to a person or object.

Detritus: As used in this disclosure, detritus refers to an accumulation of unwanted material on a surface.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Fitting: As used in this disclosure, a fitting is a component that attaches a first object to a second object. The fitting is used to form a fluidic connection between the first object and the second object.

Flexible: As used in this disclosure, flexible refers to an object or material that will deform when a force is applied to it but that will not necessarily return to its original shape when the deforming force is removed.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Fluid Impermeable: As used in this disclosure, the term fluid impermeable refers to: a) the ability of a structure to not allow a fluid to pass through the structure; or, b) the ability of a material not absorb through the exterior surfaces of the material a fluid that the material is immersed in or exposed to.

Fluidic Connection: As used in this disclosure, a fluidic connection refers to a tubular structure that transports a fluid from a first object to a second object. Methods to design and use a fluidic connections are well-known and documented in the mechanical, chemical, and plumbing arts.

Gas: As used in this disclosure, a gas refers to a state (phase) of matter that is fluid and that fills the volume of the structure that contains it. Stated differently, the volume of a gas always equals the volume of its container.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Hose: As used in this disclosure, a hose is a flexible hollow prism-shaped device that is used for transporting liquids and gases. When referring to a hose in this disclosure, the terms inner dimension and outer dimension are used as they would be used by those skilled in the plumbing arts.

Inflatable Structure: As used in this disclosure, an inflatable structure is a fluid impermeable semi-rigid structure that is configured to contain a gas under pressure. The volume of the containment space formed by the inflatable structure is a function of the pressure differential between the pressure of the gas contained within the inflatable structure and the pressure of the exterior gas surrounding the inflatable structure.

Inflation: As used in this disclosure, inflation refers to filling the interior of an enclosed fluid impermeable semi-rigid structure with gas at a pressure greater than the exterior gas pressure of the enclosed fluid impermeable semi-rigid structure. The infinitive of the verbal form for inflation is to inflate.

Liquid: As used in this disclosure, a liquid refers to a state (phase) of matter that is fluid and that maintains, for a given pressure, a fixed volume that is independent of the volume of the container.

Phase: As used in this disclosure, phase refers to the state of the form of matter. The common states of matter are solid, liquid, gas, and plasma.

Port: As used in this disclosure, a port is an aperture formed in an object that allows fluid to flow through the boundary of the object.

Pump: As used in this disclosure, a pump is a mechanical device that uses suction or pressure to raise or move fluids, compress fluids, or force a fluid into an inflatable object. Within this disclosure, a compressor refers to a pump that is dedicated to compressing a fluid or placing a fluid under pressure.

Relaxed Shape: As used in this disclosure, a structure is considered to be in its relaxed state when no shear, strain, or torsional forces are being applied to the structure.

Solid: As used in this disclosure, a solid refers to a state (phase) of matter that: 1) has a fixed volume; and, 2) does not flow.

Suction: As used in this disclosure, suction refers to the generation of a vacuum that is used to transport an object.

Vacuum: As used in this disclosure, vacuum is used to describe a first space that contains gas at a reduced gas pressure relative to the gas pressure of a second space. If the first space and the second space are connected together, this pressure differential will cause gas from the second space to move towards the first space until the pressure differential is eliminated.

Vacuum Cleaner: As used in this disclosure, a vacuum cleaner is a domestic appliance that generates a suction used to remove debris from a surface. A "wet-dry vacuum" refers to a vacuum cleaner that: a) passes the removed debris through a water reservoir; and/or, b) is capable of removing fluid from a surface. Always use vacuum suction, debris and and/or.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A kit for a salon and barbershop comprising:

an anti-fatigue floor mat, a hose, and a broom;

wherein the anti-fatigue floor mat comprises;

a cushion structure forming a pedestal on which an individual stands, the cushion structure comprising an inflatable bladder structure and an input port configured to connect to one end of the hose;

wherein the broom comprises;

a handle structure forming a grip used to carry and manipulate the broom, a broom structure configured for sweeping detritus, a working element configured to pump pressurized air to a discharge port and create a vacuum suction pressure configured to draw the detritus into the broom for storage and subsequent disposal and to pump pressurized air to a discharge port, the discharge port configured to connect to another end of the hose;

wherein the broom is configured to sweep and collect detritus from the anti-fatigue floor mat and the surrounding floor; and wherein the input port of the anti-fatigue floor mat and the discharge port of the broom are fluidically connectable with the hose allowing the cushion structure to be inflated by the pressurized air from the working element.

2. The kit for a salon and barbershop according to claim 1;

wherein the inflated cushion structure forms a pad;

wherein the cushion structure forms an elastic structure when inflated.

3. The kit for a salon and barbershop according to claim 1 wherein the intake port is a fitting.

4. The kit for a salon and barbershop according to claim 1 wherein the hose is a flexible tubular structure;

wherein the hose is a fluid transport structure;

wherein the hose forms a fluidic connection between the discharge port and the input port.

5. The kit for a salon and barbershop according to claim 4 wherein the handle structure is a rigid structure;

wherein the handle structure attaches to the working element and the broom structure.

6. The kit for a salon and barbershop according to claim 5 the broom structure generates a friction used to clean the anti-fatigue floor mat;

wherein the working element generates the vacuum used to remove detritus from the anti-fatigue floor mat;

wherein the working element generates the pressurized air used to inflate the cushion structure.

7. The kit for a salon and barbershop according to claim 6 wherein the broom structure is used to collect detritus that has fallen on the anti-fatigue floor mat and the surrounding floor;

wherein the broom structure brings the detritus to a single location that allows the vacuum generated by the working element to draw the detritus into the broom for storage.

8. The kit for a salon and barbershop according to claim 7 wherein the discharge port is a fitting.

* * * * *